US012077345B2

(12) United States Patent
Benoit-Gonin et al.

(10) Patent No.: US 12,077,345 B2
(45) Date of Patent: Sep. 3, 2024

(54) CLOSURE

(71) Applicant: Obrist Closures Switzerland GmbH, Reinach (CH)

(72) Inventors: Claude Benoit-Gonin, Saint-Georges-de-Reneins (FR); Sebastien Widmer, Reinach (CH); Axel Rognard, Saint-Georges-de-Reneins (FR); Lino Dreyer, Reinach (CH); Graeme Hood, Reinach (CH)

(73) Assignee: Obrist Closures Switzerland GMBH, Reinach (CH)

( * ) Notice: Subject to any disclaimer, the term of this patent is extended or adjusted under 35 U.S.C. 154(b) by 0 days.

(21) Appl. No.: 17/050,685

(22) PCT Filed: Apr. 26, 2019

(86) PCT No.: PCT/EP2019/060763
§ 371 (c)(1),
(2) Date: Oct. 26, 2020

(87) PCT Pub. No.: WO2019/207119
PCT Pub. Date: Oct. 31, 2019

(65) Prior Publication Data

US 2021/0039840 A1 Feb. 11, 2021

(30) Foreign Application Priority Data

| | | |
|---|---|---|
| Apr. 26, 2018 | (GB) | 1806855 |
| Oct. 1, 2018 | (GB) | 1816019 |
| Dec. 12, 2018 | (GB) | 1820203 |

(51) Int. Cl.
*B65D 41/34* (2006.01)
*B65D 55/16* (2006.01)

(52) U.S. Cl.
CPC ..... *B65D 41/3447* (2013.01); *B65D 55/16* (2013.01); *B65D 2401/20* (2020.05); *B65D 2401/30* (2020.05); *B65D 2401/35* (2020.05)

(58) Field of Classification Search
CPC ..... B65D 41/3447; B65D 55/16; B65D 2401/20; B65D 2401/30; B65D 2401/35;
(Continued)

(56) References Cited

U.S. PATENT DOCUMENTS 2,961,119 A 11/1960 Leach
2,990,077 A 6/1961 Van Baarn
(Continued)

FOREIGN PATENT DOCUMENTS

CN 1631740 A 6/2005
CN 1631741 A * 6/2005 ..... B65D 41/38
(Continued)

OTHER PUBLICATIONS

CN 1830730 issued to Yongjun. English Translation of Description from Espacenet. (Year: 2006).*
(Continued)

*Primary Examiner* — Nathan J Jenness
*Assistant Examiner* — Eric C Baldrighi
(74) *Attorney, Agent, or Firm* — Maynard Nexsen PC; Ilya S. Mirov

(57) ABSTRACT

A closure (10) for a container mouth, comprising a cap (15) and a retaining ring (20) for retaining the closure on a container mouth, a tether (45) is provided between the cap side wall and the retaining ring along the circumference of the cap, one end of the tether is fixedly connected to the side wall and the other end is fixedly connected to the retaining ring, in which the tether is connected to the cap by a root (30) and extends from the root in a clockwise direction.

17 Claims, 22 Drawing Sheets

(58) Field of Classification Search
CPC .... B65D 2401/40; B65D 41/32; B65D 41/34; B65D 41/3423; B65D 41/3442
USPC ..... 215/252
See application file for complete search history.

(56) References Cited

U.S. PATENT DOCUMENTS

| | | | | |
|---|---|---|---|---|
| 3,986,627 | A | 10/1976 | Zapp | |
| 4,394,918 | A | 7/1983 | Grussen | |
| 4,432,461 | A | 2/1984 | Mumford et al. | |
| 4,487,324 | A | 12/1984 | Ostrowsky | |
| 4,513,870 | A | 4/1985 | Zaltsman | |
| 4,744,480 | A | 5/1988 | Luch et al. | |
| 4,805,792 | A | 2/1989 | Lecinski | |
| 4,895,265 | A | 1/1990 | Luch et al. | |
| 4,904,435 | A | 2/1990 | Babcock et al. | |
| 5,074,425 | A | 12/1991 | Wuestmann et al. | |
| 5,215,204 | A * | 6/1993 | Beck | B65D 55/16 215/258 |
| 5,295,600 | A | 3/1994 | Kowal | |
| 5,725,115 | A * | 3/1998 | Bosl | B65D 55/16 215/258 |
| 5,836,468 | A | 11/1998 | Boesl et al. | |
| 6,474,491 | B1 * | 11/2002 | Benoit-Gonin | B65D 41/3428 220/263 |
| 6,739,466 | B1 | 5/2004 | Culley | |
| 7,513,377 | B1 | 4/2009 | Culley | |
| 7,591,398 | B2 * | 9/2009 | Pritikin | B65D 47/147 220/267 |
| 8,469,213 | B2 | 6/2013 | Ishii et al. | |
| 8,720,716 | B2 * | 5/2014 | Campbell | B65D 41/3428 215/253 |
| 9,010,555 | B2 | 4/2015 | Luzzato et al. | |
| 9,108,774 | B2 | 8/2015 | Kwon | |
| 11,685,575 | B2 | 6/2023 | Dreyer et al. | |
| 2009/0026166 | A1 | 1/2009 | Druitt | |
| 2011/0100948 | A1 | 5/2011 | Lohrman et al. | |
| 2011/0114593 | A1 | 5/2011 | Ishii et al. | |
| 2011/0278216 | A1 | 11/2011 | Hull et al. | |
| 2011/0297682 | A1 | 12/2011 | Kwon | |
| 2012/0285921 | A1 | 11/2012 | Kwon | |
| 2015/0251795 | A1 | 9/2015 | Tsui | |
| 2015/0251827 | A1 * | 9/2015 | Campbell | B65D 55/16 215/258 |
| 2015/0368002 | A1 | 12/2015 | Stevens et al. | |
| 2017/0240326 | A1 | 8/2017 | Rognard et al. | |
| 2020/0207525 | A1 | 7/2020 | Sung | |
| 2021/0122532 | A1 | 4/2021 | Dreyer et al. | |
| 2021/0188488 | A1 | 6/2021 | Dreyer et al. | |

FOREIGN PATENT DOCUMENTS

| | | | | |
|---|---|---|---|---|
| CN | 1830730 | | 9/2006 | |
| CN | 102700822 | A | 10/2012 | |
| CN | 102700823 | | 10/2012 | |
| CN | 102700823 | A * | 10/2012 | B65D 55/16 |
| CN | 203958920 | U | 11/2014 | |
| CN | 107646016 | A * | 1/2018 | B65D 47/0809 |
| EP | 2960173 | A1 | 12/2015 | |
| FR | 1183399 | A | 7/1959 | |
| FR | 2499519 | A1 | 8/1982 | |
| FR | 2785264 | A1 | 5/2000 | |
| FR | 3094353 | A1 | 10/2020 | |
| FR | 3106582 | A1 | 7/2021 | |
| FR | 3106583 | A1 | 7/2021 | |
| GB | 2224309 | A | 5/1990 | |
| JP | H10175656 | A * | 12/1996 | B65D 41/34 |
| JP | 2001019002 | A1 | 1/2001 | |
| JP | 2006232392 | A | 9/2006 | |
| JP | 2014031202 | A | 2/2014 | |
| KR | 20020075345 | | 10/2002 | |
| KR | 20060040650 | | 5/2006 | |
| KR | 20080029988 | | 4/2008 | |
| KR | 100880006 | B1 | 1/2009 | |
| KR | 100942642 | B1 | 2/2010 | |
| KR | 20100029797 | A | 3/2010 | |
| KR | 20110001730 | A | 1/2011 | |
| TW | 313647 | | 6/2007 | |
| TW | M313647 | U | 6/2007 | |
| TW | 201704106 | A | 2/2017 | |
| WO | 9857864 | A1 | 12/1998 | |
| WO | 0048920 | A1 | 8/2000 | |
| WO | 2008048039 | A1 | 4/2008 | |
| WO | 2009048273 | A | 4/2009 | |
| WO | 2009141700 | A1 | 11/2009 | |
| WO | 2019207148 | A1 | 10/2010 | |
| WO | 2010128288 | A1 | 11/2010 | |
| WO | 2011093597 | A2 | 8/2011 | |
| WO | 2014122485 | A2 | 8/2014 | |
| WO | 2017068151 | | 4/2017 | |
| WO | 2019207149 | A1 | 10/2019 | |
| WO | 2019207152 | A1 | 10/2019 | |
| WO | 2019207153 | A1 | 10/2019 | |

OTHER PUBLICATIONS

Mans-Kamerbeek, "International Search Report and Written Opinion for PCT/EP2019/060763," International Searching Authority; dated Jan. 10, 2020.
Mans-Kamerbeek, "International Preliminary Report on Patentability," International Preliminary Examining Authority; dated May 8, 2020.
Mans-Kamerbeek, "Examination Report for 19722540.2," European Patent Office; dated Oct. 1, 2021.
Claudia Aragone, "Communication Pursuant to Rule 114(2) EPC—Third Party Observation for Application No. EP20190722540," European Patent Office; dated Oct. 5, 2021.
Examination Report received in GB application No. 202016335.8 dated Dec. 19, 2022.
Examination Report received in GB application No. 202016335.8 dated Feb. 10, 2023.
Examination Report received in GB application No. 202016335.8 dated Feb. 27, 2023.
Examination Report received in GB application No. 202018361 dated Apr. 5, 2023.
Examination Report received in GB application No. 202018361 dated Mar. 30, 2022.
International Search Report & Written Opinion received in PCT Application No. PCT/EP2019/060763 dated Jan. 10, 2020.
International Search Report & Written Opinion received in PCT Application No. PCT/EP2019/060820 dated Sep. 20, 2019.
International Search Report & Written Opinion received in PCT Application No. PCT/EP2019/060821 dated Sep. 19, 2019.
International Search Report & Written Opinion received in PCT Application No. PCT/EP2019/060826 dated Sep. 26, 2019.
International Search Report & Written Opinion received in PCT Application No. PCT/EP2019/060830 dated Feb. 20, 2020.
International Preliminary Report on Patentability received in PCT Application No. PCT/EP2019/060763 completion on May 8, 2020.
International Preliminary Report on Patentability received in PCT Application No. PCT/EP2019/060821 completion on Aug. 6, 2020.
International Preliminary Report on Patentability received in PCT Application No. PCT/EP2019/060826 completion on Jun. 5, 2020.
International Preliminary Report on Patentability received in PCT Application No. PCT/EP2019/060830 completion on Nov. 9, 2020.
Jul. 22, 2004—{EP) Third-Party observations—App 19722541.0.
Observations under Art. 115 EPC against EP3784587, third party observations filed in related EP3784587.
Office Action received for EP 19722540.2 dated Oct. 1, 2021.
Office Action received for EP 19722541.0 dated Sep. 30, 2022.
Office Action received for EP 19722543.6 dated Nov. 18, 2021.
Office Action received for EP 19722544.4 dated Jan. 2, 2023.
Sep. 15, 2021—Third Party Observation for application No. EP 20190722541.
Communication from the Examining Division received for European Patent Application No. 19722541.0, mailed on Oct. 4, 2021, 06 pages.

(56) References Cited

OTHER PUBLICATIONS

Search Report received for United Kingdom Patent Application No. GB2018361.2, mailed on Nov. 28, 2022, 05 pages.
Search Report received for United Kingdom Patent Application No. GB2018361.2, mailed on May 17, 2023, 04 pages.
Search Report received for United Kingdom Patent Application No. GB2218481.6, mailed on Feb. 23, 2023, 07 pages.
Search Report received for United Kingdom Patent Application No. GB2218481.6, mailed on Mar. 23, 2023, 06 pages.
International preliminary report on patentability Chapter II received for International Patent Application No. PCT/EP2019/060820, mailed on Oct. 26, 2020, 11 pages.
International preliminary report on patentability Chapter II received for International Patent Application No. PCT/EP2019/060826, mailed on Oct. 26, 2020, 09 pages.

* cited by examiner

CLOSURE

CROSS-REFERENCE TO RELATED APPLICATIONS

This application is a national stage under 35 U.S.C. 371 of International Application No. PCT/EP2019/060763 having an international filing date of Apr. 26, 2019 (currently published). International Application No. PCT/EP2019/060763 cites the priority of GB Patent Application No. 1806855.1, filed Apr. 26, 2018 (abandoned), GB Patent Application No. 1816019.2, filed Oct. 1, 2018 (abandoned), and GB Patent Application No. 1820203.6, filed Dec. 12, 2018 (abandoned).

The present invention relates generally to a tethered closure cap and particularly, although not exclusively to a tamper-evident tethered closure.

Arranged on the lower edge of the cap wall of closure caps of this type is a retaining ring that engages beneath a bead on a container mouth when the closure cap is in position. On opening the container, only the upper cap portion is removed, while the lower retaining ring remains firmly connected to the container mouth.

A tether connects the retaining ring with the cap wall so that the cap will remain connected with the container and cannot be mislaid or discarded separately.

The retaining ring is simultaneously used as an anti-tamper ring for the display of initial opening of the container. To this end, the retaining ring may, for example, connected by means of frangible bridges with the lower edge of the cap wall. The retaining ring can slide over the bead on the container mouth on initial fitting of the closure cap without risk to the bridges; and the ring subsequently holds securely on the container mouth.

The retaining ring of such a closure cap may have one or more tongues protruding radially inwardly on its inside surface, said tongues extending towards the cap base and engaging beneath the bead on the container mouth when the closure cap is in position on the container mouth. The tongue/s are connected only at one end with the retaining ring, and their free end is able to pivot in a radial direction. On initial fitting of the closure cap, the tongue/s can therefore be pivoted outwards in the radial direction when they slide over the bead onto the container mouth.

The present invention seeks to provide improvements in or relating to tethered closures.

A first aspect provides a closure for a container mouth, comprising a cap and a retaining ring for retaining the closure on a container mouth, a tether is provided between the cap side wall and the retaining ring along the circumference of the cap, one end of the tether is fixedly connected to the side wall and the other end is fixedly connected to the retaining ring, in which the tether is connected to the cap by a root and extends from the root in a clockwise direction.

The circumferential extent of the root may be in the range 10 degrees to 40 degrees.

The closure may comprise a main line of weakness/frangible line formed between the cap and the ring.

In some embodiments a tether-forming frangible line is formed axially beneath the main frangible line.

There may be two levels of bridge break during opening. The tether may be formed below main frangible line. The tether may be formed above main frangible line. Main and tether-forming frangible lines may be substantially parallel.

The interface between the main frangible line and the tether-forming frangible line may be chicane-like or generally L-shape.

The circumferential extent of the tether-forming frangible line may be in the range 40 degrees to 70 degrees, for example approximately 55 degrees. This may be useful, for example, when the cap is intended to be docked in some way with a container such a by engaging under a neck support ring (see below).

The circumferential extent of the tether-forming frangible line is in the range 70 degrees to 120 degrees, for example approximately 90 degrees. This may be useful, for example, when the cap is intended to be docked in some way with a container such a by engaging in a pocket/dock/recess (see below).

In some embodiments the retaining ring may include a bead for retaining the ring on a container mouth. Alternatively or additionally the retaining ring may comprise one or more retaining flaps for retaining the ring on a container mouth.

The cross section of the tether may be in the range 0.5 $mm^2$ to 3 $mm^2$, for example approximately 0.5 $mm^2$, 1 $mm^2$, 1.5 $mm^2$, 2 $mm^2$, 2.5 $mm^2$ or 3 $mm^2$ The closure may comprise one or more frangible lines. The frangible line/s may be formed by moulded bridges and/or by slitting.

The present invention may provide a slitted or moulded lasso tether.

Some example of closure types that may be formed in accordance with the present invention include:

- 1 piece closure with chicane and moulded bridge lasso tether
- 1 piece closure with chicane and slit bridge lasso tether
- 1 piece closure with folded band and slit bridge lasso tether
- 1 piece closure with folded band and moulded bridge lasso tether
- 1 piece closure with retaining bead and moulded bridge lasso tether
- 1 piece closure with retaining bead and slit bridge lasso tether The tether may be formed in the ring. In some embodiments the tether is formed entirely in the ring i.e. no part of the tether extends into the cap sidewall.

In some embodiments the tethered cap can assume a docked position in/on/under a container mouth.

The cap may comprise a top plate and a side wall depending from the periphery thereof, the retaining ring being arranged axially beneath the side wall, The cap comprises a base and a lid hingedly connected together and a dispensing member, the retaining ring is formed on the base.

In some embodiments the closure is a flip-top sports closure.

A further aspect provides a closure in combination with a container neck, the closure comprising a cap, and a retaining ring for retaining the closure on the container neck, a tether is provided between the cap and the retaining ring, one end of the tether is fixedly connected to the cap and the other end is fixedly connected to the retaining ring, the tether is connected to the cap by a root and extends from the root in a clockwise, cap screwing-on direction, the ring is rotatable but exerts a compression force on the container neck and the cap is freely rotatable, whereby in use when the cap is screwed onto the neck the ring rotates less than the cap and causes the tether to buckle.

The retaining ring is therefore retarded as it rotates together with the cap. The difference in rotation causes the cap to "overtake" the ring and this causes deformation of the tether. This deformation can be used as an additional visual form of tamper evidence.

The closure cap may additionally be dockable. Deformation of the tether occurs after opening, docking and reapplication.

A further aspect provides a tethered tamper-evident closure in combination with a container, the closure comprising a cap, and a retaining ring for retaining the closure on the container neck, a tether is provided between the cap and the retaining ring, one end of the tether is fixedly connected to the cap and the other end is fixedly connected to the retaining ring, the tether is connected to the cap by a root, the container includes a docking recess into which the cap can be securely fitted.

The recess may be oriented so that an approximately range of 45 to 180 degrees twist of the cap is required to dock.

In some embodiments the tether extends from the root in a clockwise direction. Anti-clockwise extending lasso tethers may also be provided in combination with a dockable cap.

The present invention also provides a closure for a container mouth, comprising a cap and a retaining ring for retaining the closure on a container mouth, a helical frangible line being provided in the closure for defining a tether between the cap and the ring.

The angular extent of the frangible line may be in the range 360 to 720 degrees. For example the angular extent of the tether may be approximately 60 degrees, formed by a frangible line of approximately 420 degrees.

The cross section of the tether may be in the range 0.5 $mm^2$ to 3 $mm^2$, for example approximately 1.5 $mm^2$, 1 $mm^2$, 1.5 $mm^2$, 2 $mm^2$, 2.5 $mm^2$ or 3 $mm^2$.

The cross section of the "strand/strap" (height multiplied by thickness) may be in the range is 0.5 $mm^2$ to 3 $mm^2$, for example 0.7 mm×0.7 mm.

In some embodiments the pitch of the frangible line is arranged to provide a minimum traction force of 30 Newtons.

The line may be formed by moulded bridges. Alternatively or additionally the frangible line may be slit (pre or post capping).

A further aspect provides a closure for a container mouth, comprising a cap and a retaining ring for retaining the closure on a container mouth, a tether is provided between the cap side wall and the retaining ring, one end of the tether is fixedly connected to the side wall and the other end is fixedly connected to the retaining ring, in which the cap is provided with means for adhering it to a container.

In some embodiments a peel-off glue sticker is provided on the tethered cap for adhering it to a container, for example a closure with a lasso type tamper-evident band. The adhesion may be permanent, or temporary (i.e. the cap could be released from the container and replaced on the container neck). This could be useful, for example to keep the cap away from a drinking zone.

Examples of materials that could be used to form closures in accordance with the present invention include plastics materials such as polyethylene (for example high density polyethylene).

The present invention also provides for caps and closures in combination with containers.

Different aspects and embodiments of the invention may be used separately or together.

Further particular and preferred aspects of the present invention are set out in the accompanying independent and dependent claims. Features of the dependent claims may be combined with the features of the independent claims as appropriate, and in combination other than those explicitly set out in the claims. Each aspect can be carried out independently of the other aspects or in combination with one or more of the other aspects.

The present invention will now be more particularly described, by way of example, with reference to the accompanying drawings.

The example embodiments are described in sufficient detail to enable those of ordinary skill in the art to embody and implement the systems and processes herein described. It is important to understand that embodiments can be provided in many alternative forms and should not be construed as limited to the examples set forth herein.

Accordingly, while embodiments can be modified in various ways and take on various alternative forms, specific embodiments thereof are shown in the drawings and described in detail below as examples. There is no intent to limit to the particular forms disclosed. On the contrary, all modifications, equivalents, and alternatives falling within the scope of the appended claims should be included. Elements of the example embodiments are consistently denoted by the same reference numerals throughout the drawings and detailed description where appropriate.

Unless otherwise defined, all terms (including technical and scientific terms) used herein are to be interpreted as is customary in the art. It will be further understood that terms in common usage should also be interpreted as is customary in the relevant art and not in an idealised or overly formal sense unless expressly so defined herein.

In the following description, all orientational terms, such as upper, lower, radially and axially, are used in relation to the drawings and should not be interpreted as limiting on the invention.

DETAILED DESCRIPTION OF THE DRAWINGS

Figure 1:
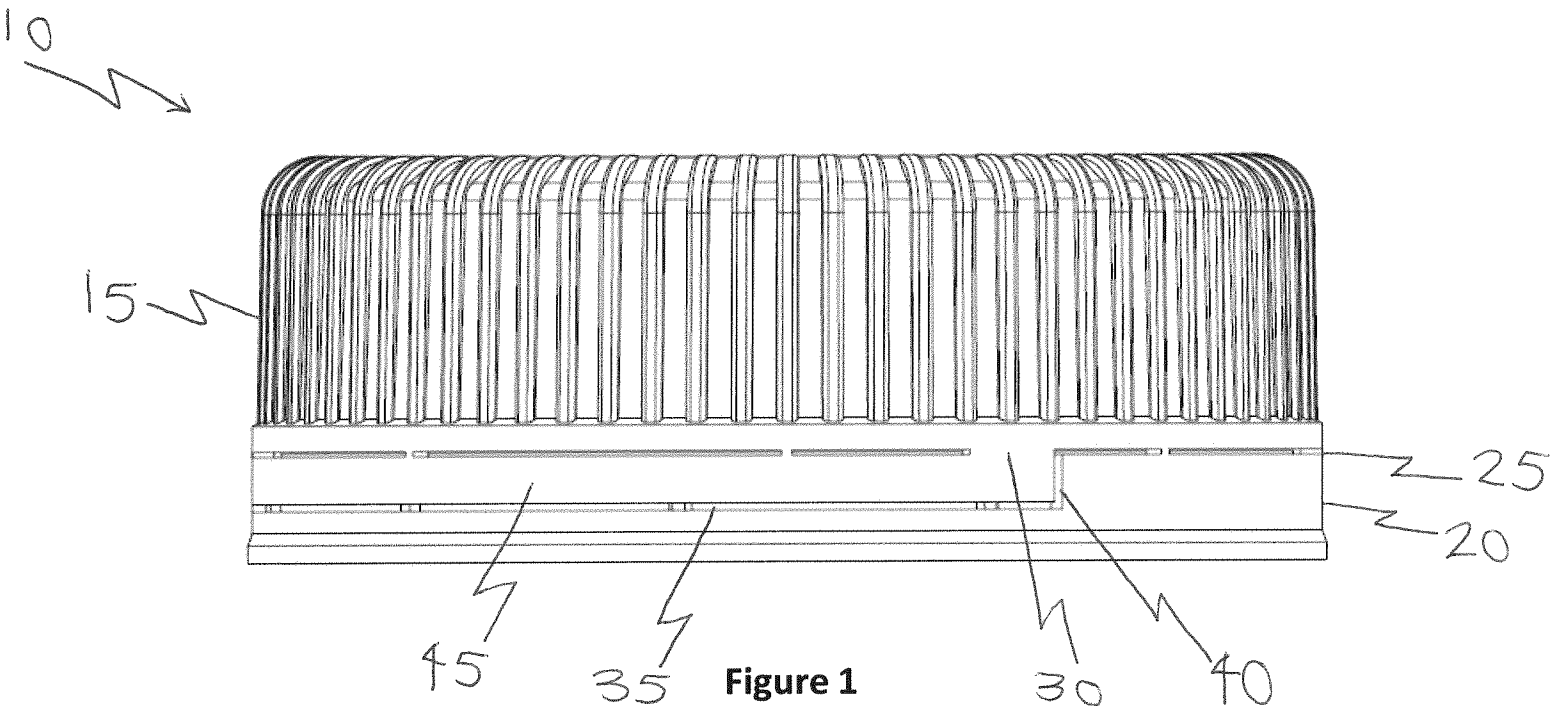
FIG. 1 is an elevational view of a tethered closure in accordance with the present invention.

Referring first to FIG. 1 there is shown a tethered closure generally indicated 10.

The closure 10 comprises an upper cap 15 and a lower retaining ring 20.

At the bottom of the cap 15 a circumferential frangible line 25 (in this embodiment formed by slitting to form frangible bridges) extends. The line 25 is frangible around all of its length except for a root portion 30, which is non-frangible.

Beneath the line and axially spaced therefrom is a tether-forming frangible line 35. This means that the line 25 starts at one side of the root portion (to the clockwise side) and finishes at the other side; and at the anticlockwise side of the root portion a frangible chicane 40 is present to join the lines 25, 35. It will be noted, therefore, that in this embodiment the line 35 (and hence the tether formed thereby) extends in a clockwise direction from the root.

There are therefore two circumferential cuts and an axial cut (which forms the chicane). The circumferential extent of the line 35 is significantly less than the line 25. The line 35 extends under the root and under (parallel to) part of the way around the line 25.

Figure 2:
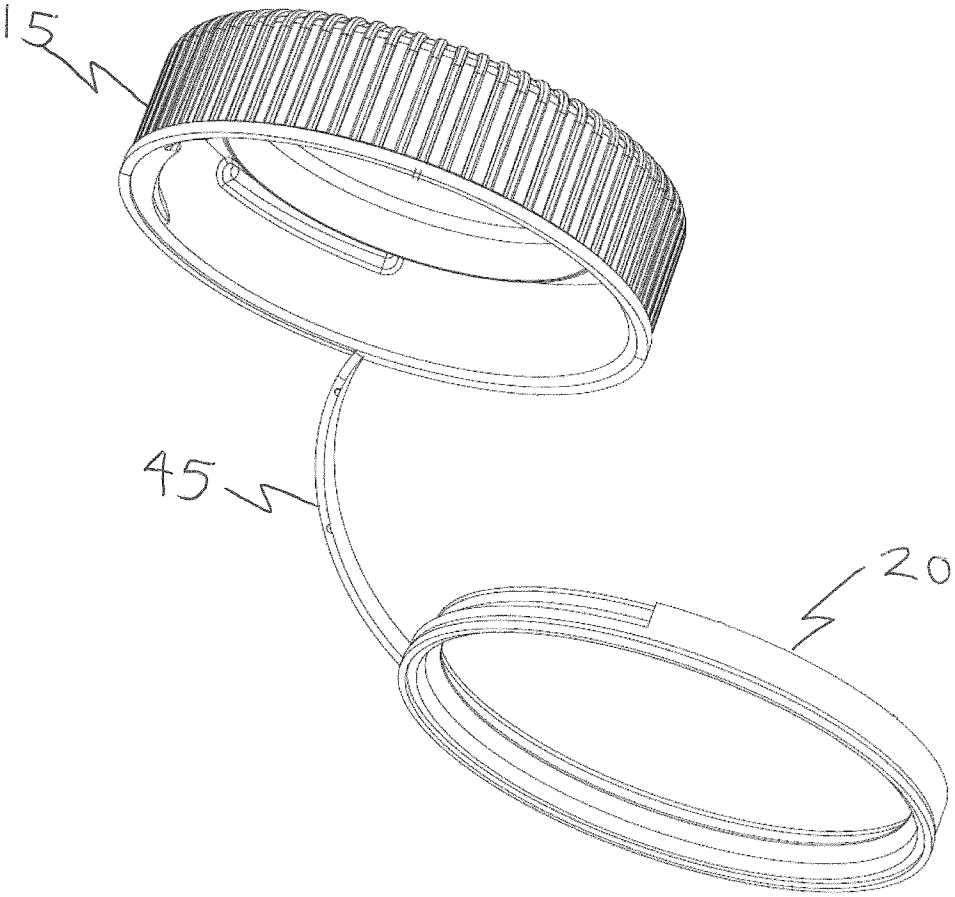
FIG. 2 is a perspective view of the closure of FIG. 1 depicting a cap to be unscrewed and a tether formed between the cap and a ring.

As illustrated in FIG. 2, together the lines 25, 35 allow the cap to be unscrewed and a tether 45 is formed between the cap and the ring.

Figure 3:
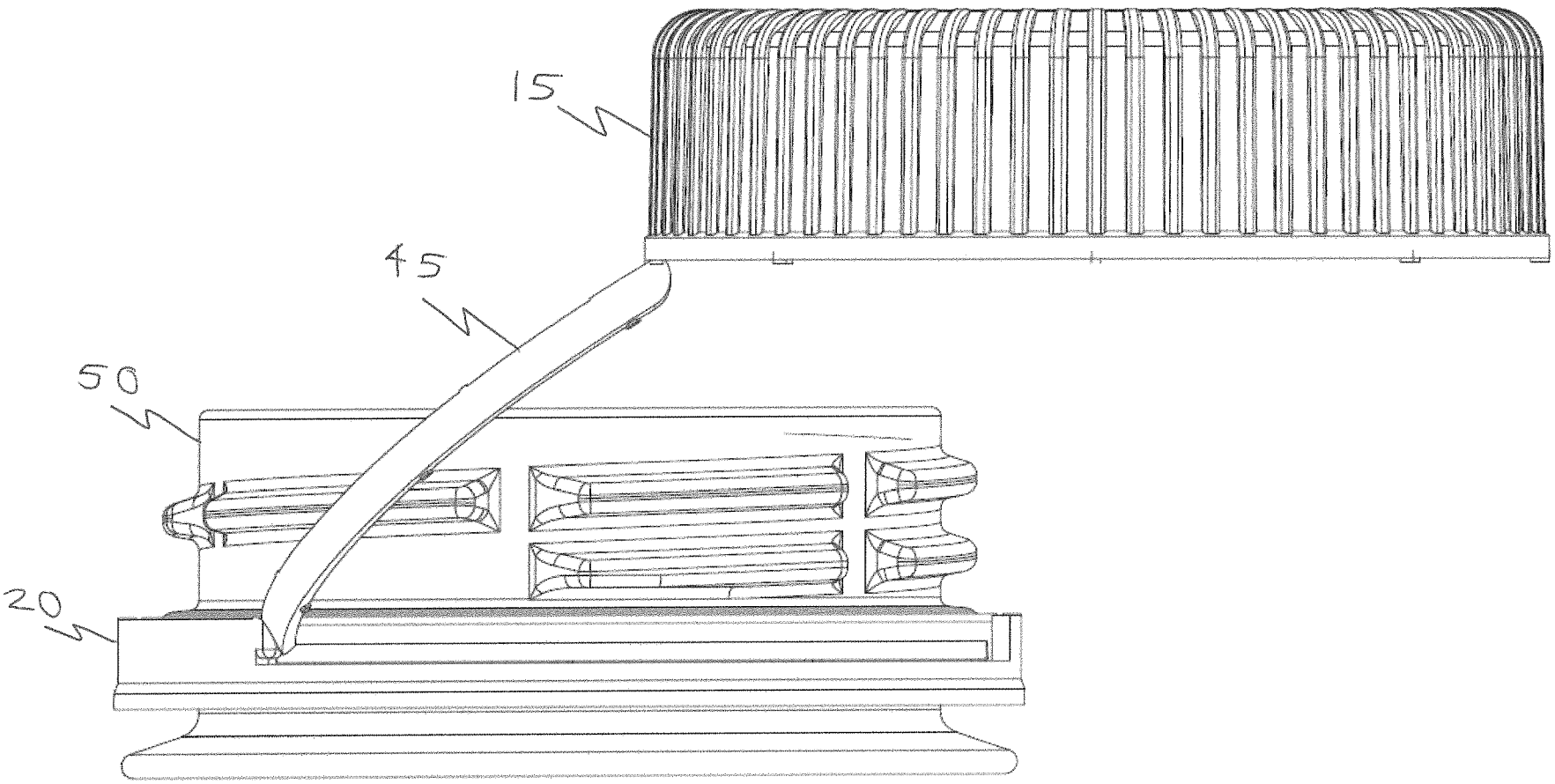
FIG. 3 is an elevational view of the closure of FIG. 2 depicting the ring engaged onto a container neck.

FIG. 3 shows the ring engaged onto a container neck 50. The cap 15 is shown removed, retained by the tether 45.

Figure 4:
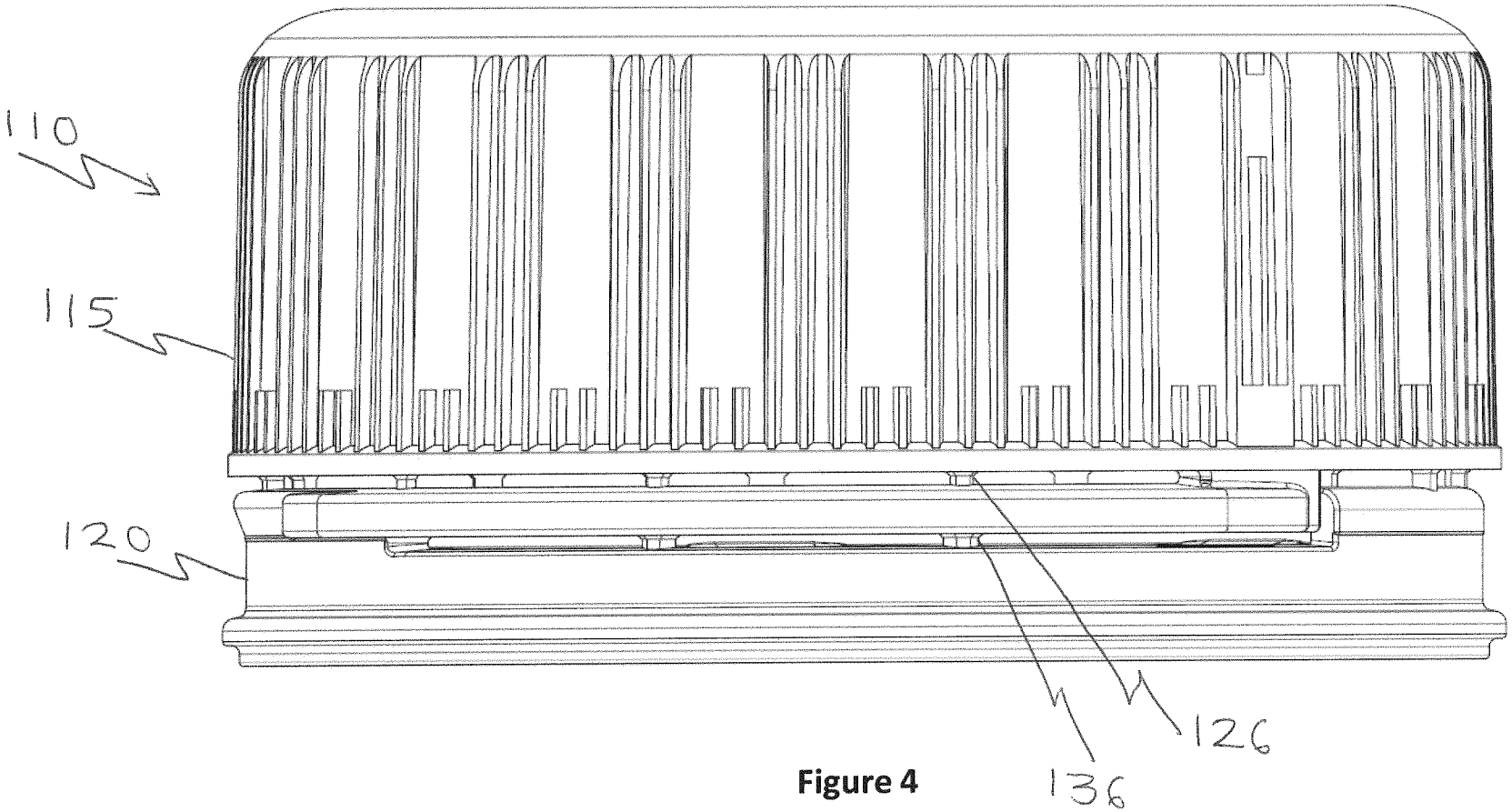
FIG. 4 is an elevational view a one-piece lasso tether closure in accordance with another embodiment of the present invention.
Figure 5:
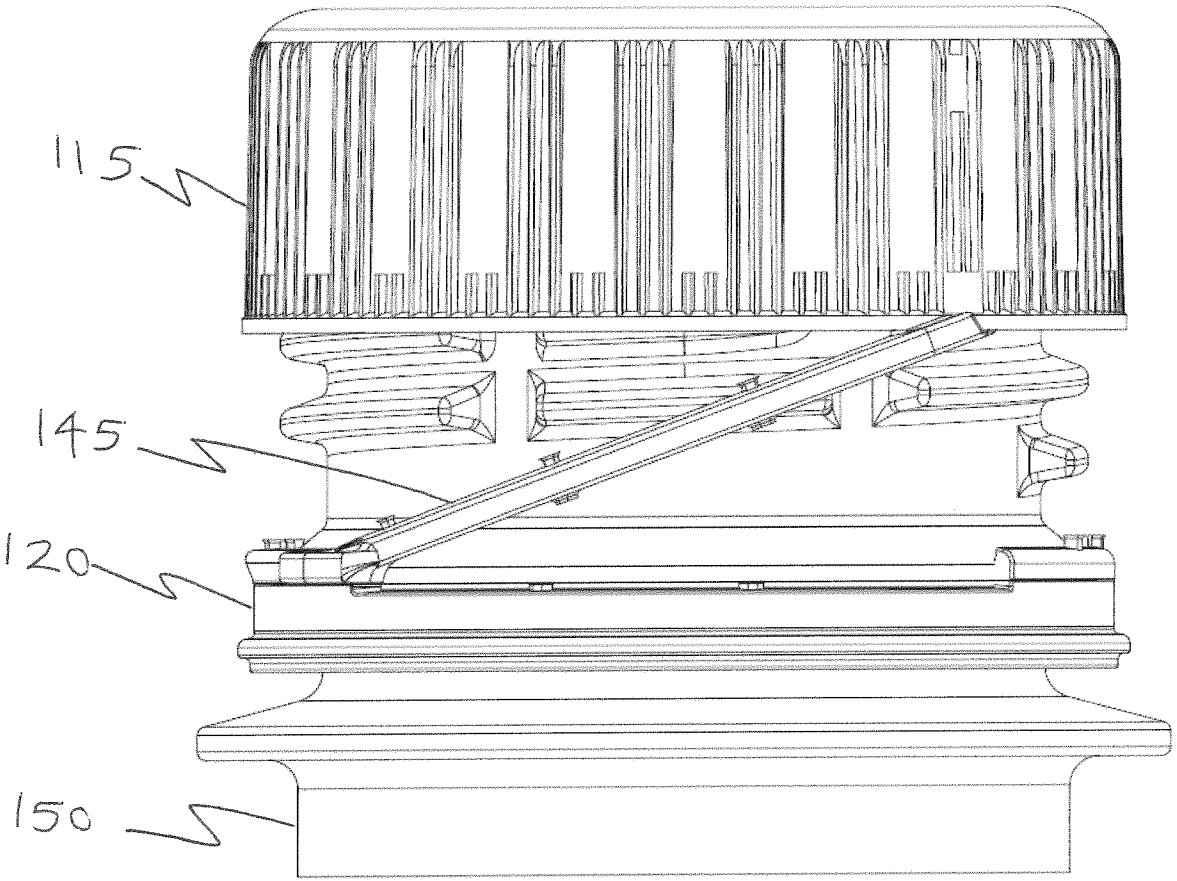
FIG. 5 is an elevational view of the closure of FIG. 4 depicting a cap therefore partially removed.
Figure 6:
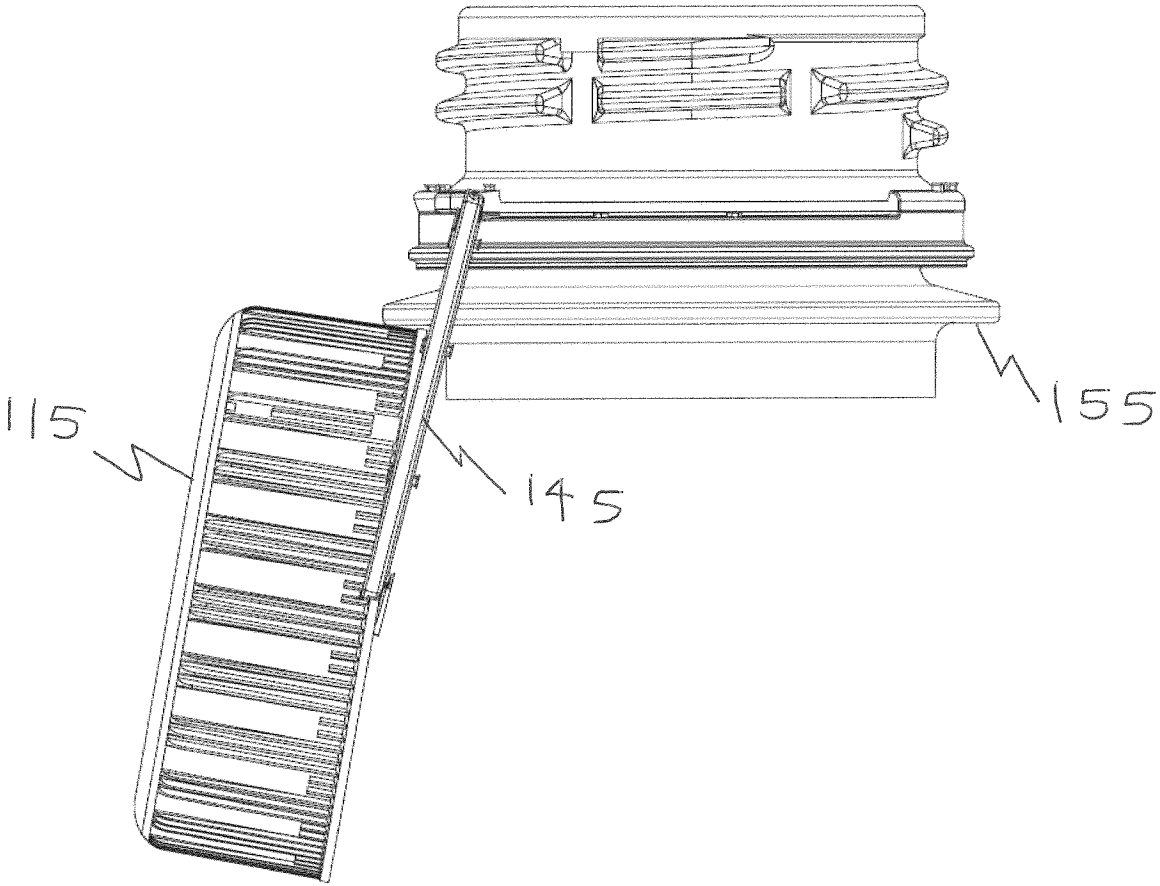
FIG. 6 is an elevational view of closure of FIG. 5 depicting the cap turned to fit under a neck support ring of the closure.
Figure 7:
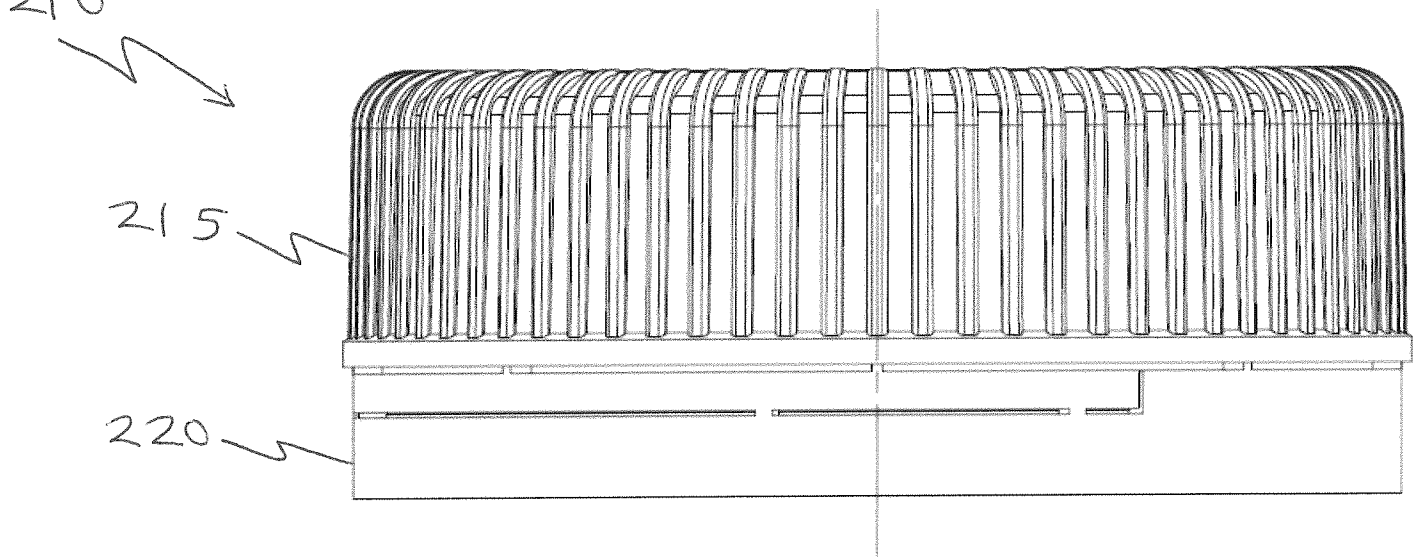
FIG. 7 is an elevational view of a closure in accordance with another embodiment of the present invention.
Figure 8:
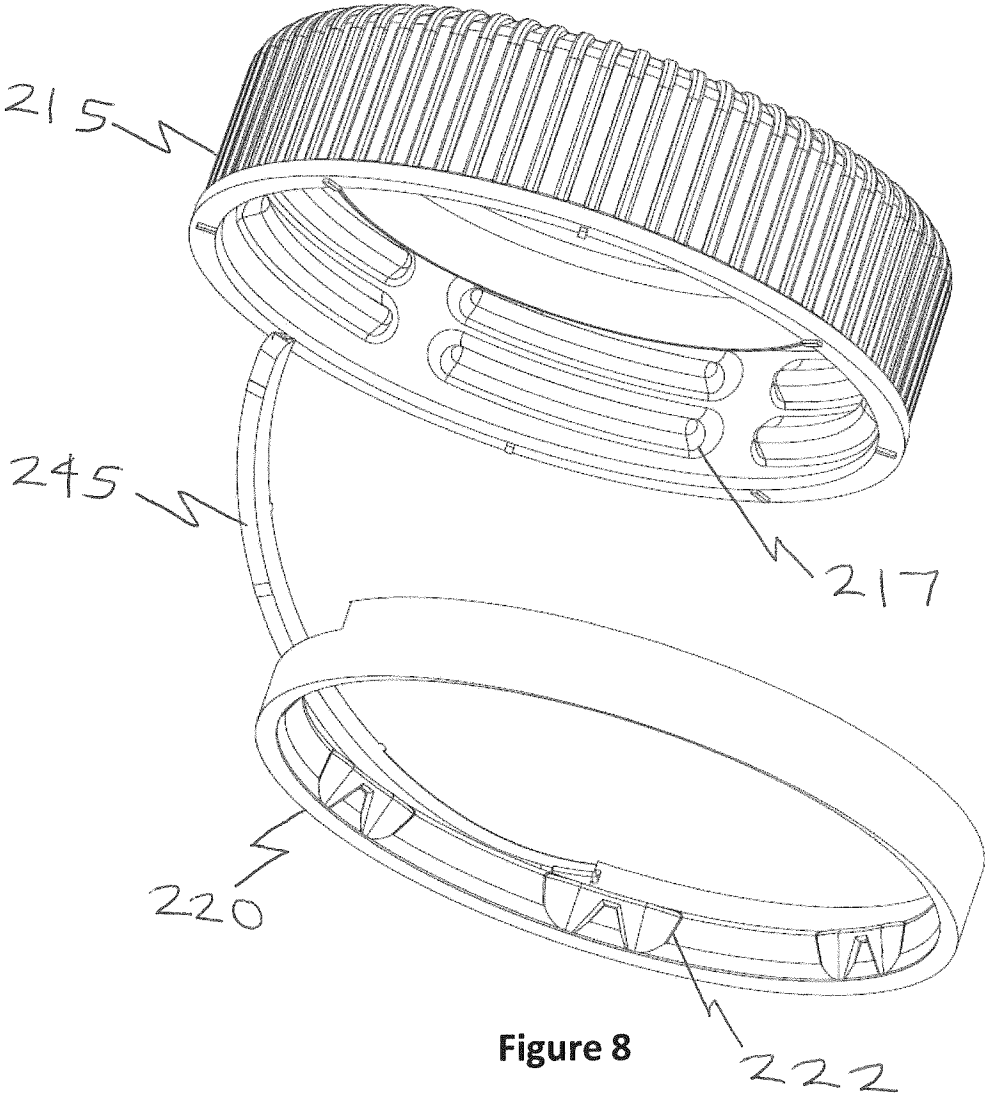
FIG. 8 is a perspective view of the closure of FIG. 7 depicting a cap to be unscrewed and a tether formed between the cap and a ring.
Figure 9:
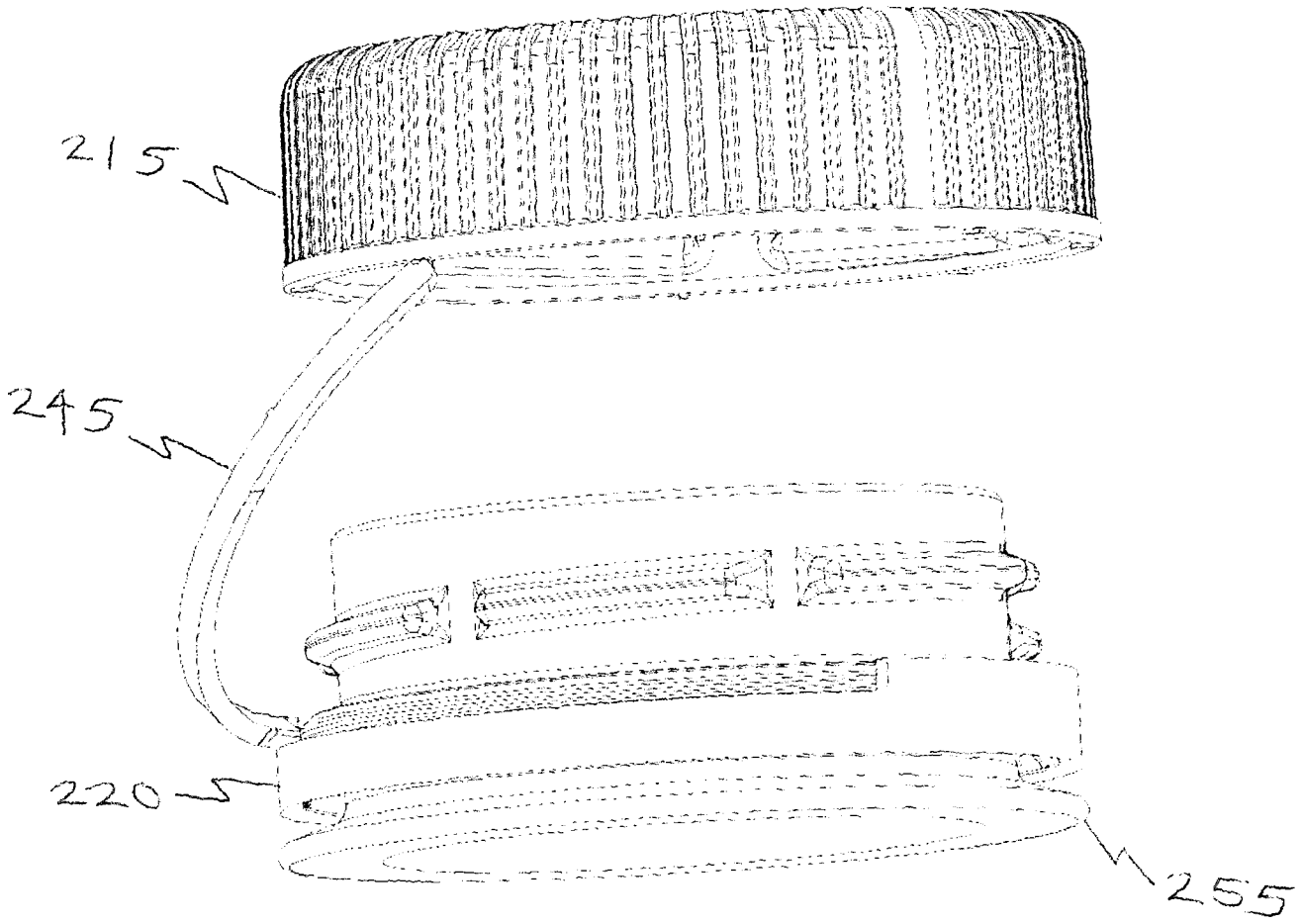
FIG. 9 is an elevational view of the closure of FIG. 6 depicting the ring engaged onto a container neck.
Figure 10:
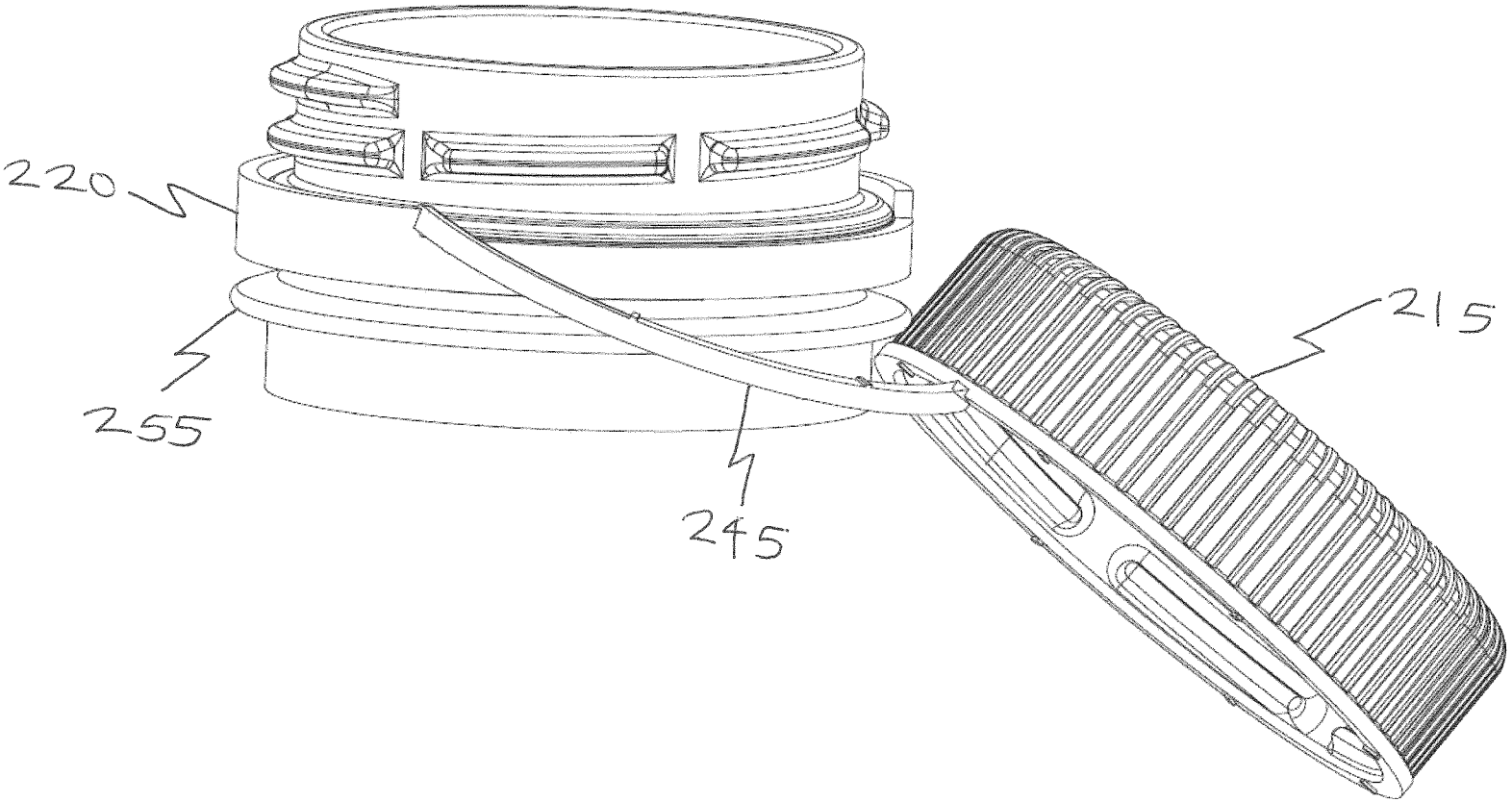
FIG. 10 is an elevational view of closure of FIG. 9 depicting the cap turned to fit under a neck support ring of the closure.

FIG. 4 shows a one-piece lasso tether closure 110 formed according to a further embodiment. In this embodiment the frangible lines are formed by moulded bridges 126, 136. FIG. 5 shows the cap 115 partially removed. The tether 145 is designed to have a length and rigidity such that the cap can be turned to fit under the neck support ring 155, as shown in FIG. 6.

FIGS. 7 to 10 show a closure 210 formed according to a further embodiment. In this embodiment the frangible bridges in the upper and lower lines are formed by slitting. The ring 220 includes scalloped flaps 222 that engage under a bead on the container neck to retain the ring. Screw threads 217 are shown on the interior of the cap 215. The cap 215 is shown removed in FIG. 9 and docked under the transport bead or neck support ring 255 in FIG. 10.

Figure 11:
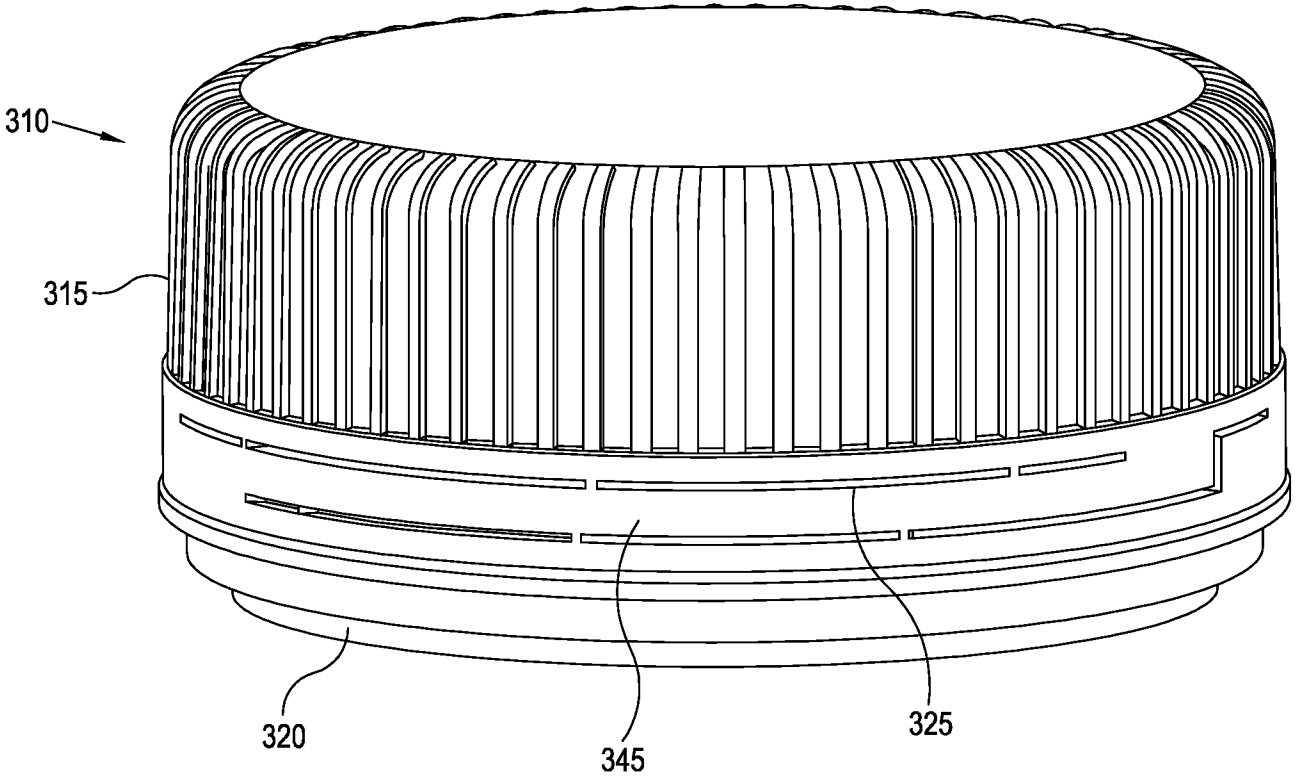
FIG. 11 is a perspective view of a closure in accordance with another embodiment of the present invention.

FIG. 11 shows a closure 310 formed according to a further embodiment. The closure comprises a tether 345 placed below the main frangible line 325. In this embodiment a folded tamper-band 320 is provided. This embodiment is a one-piece closure with a folded band and a slit bridge lasso tether.

Figure 12:
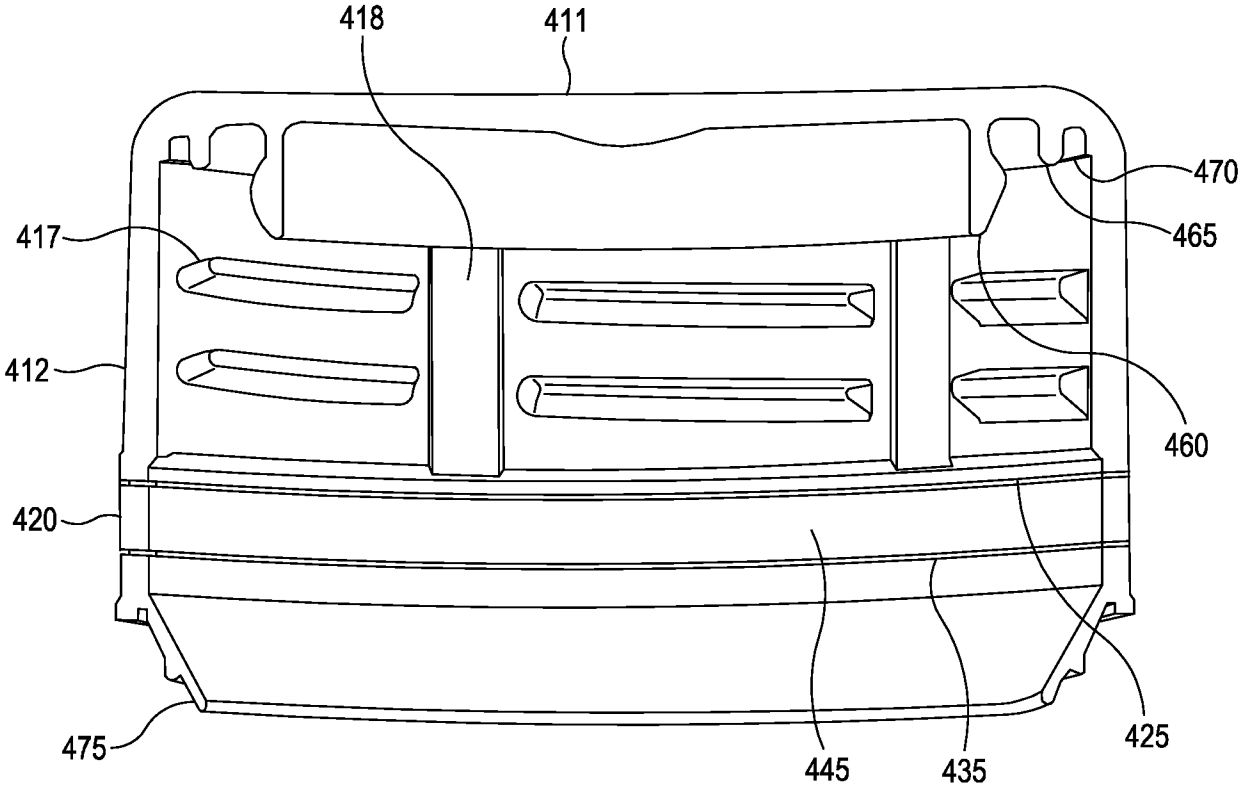
FIG. 12 is a sectional view of the closure of FIG. 11.

FIG. 12 shows a section of a closure 410 formed according to a further embodiment. The closure 410 comprises a disc-shape top plate 411 and a side skirt 412 depending from the periphery thereof. An internal screw thread formation 417 with vent channels 418 formed therein is provided on the interior of the skirt 412. An annular inner olive seal 460 depends from the top plate; and annular outer seal 465 also depends from the top plate, radially outwardly of the inner seal; a pressure block 470 is provided in the region of the intersection between the top plate and the side skirt. In use a container neck fits between the inner and outer seals; the pressure block ensures that the outer seal is pressed against the neck to ensure a seal.

The tether 445 is shown between frangible lines 425, 435.

At the free end of the ring 420 an annular folding flap 475 is provided. In use the flap folds from the downward position shown to an upward position (towards the top plate) so that it can engage under a retention bead on a container neck.

Figure 14:
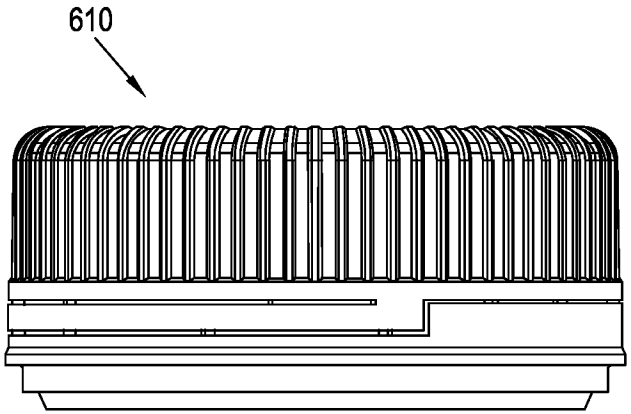
FIG. 14 is an elevational view of a closure in accordance with another embodiment of the present invention.
Figure 13:
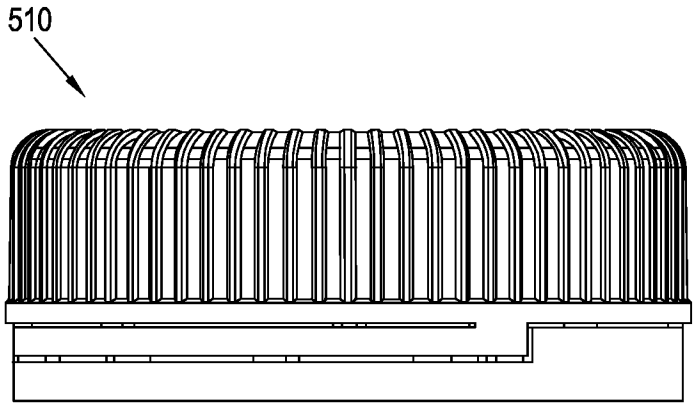
FIG. 13 is an elevational view of a closure in accordance with another embodiment of the present invention.

FIG. 13 shows a further closure 510, with frangible bridges formed by slitting. A moulded bridge closure 610 is shown in FIG. 14.

Figure 16:
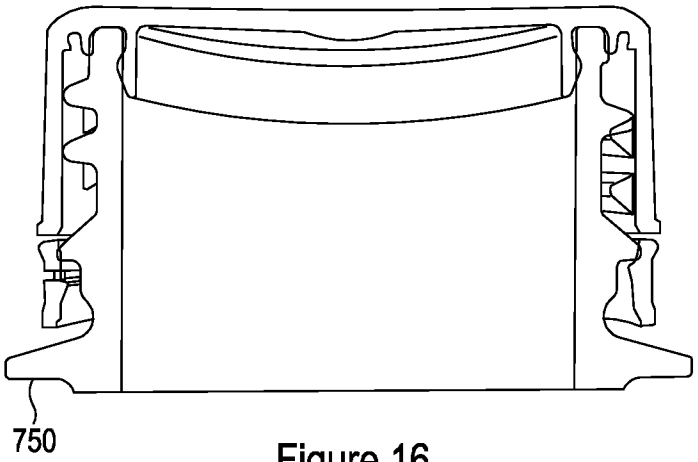
FIG. 16 is a sectional view of the closure of FIG. 15.
Figure 15:
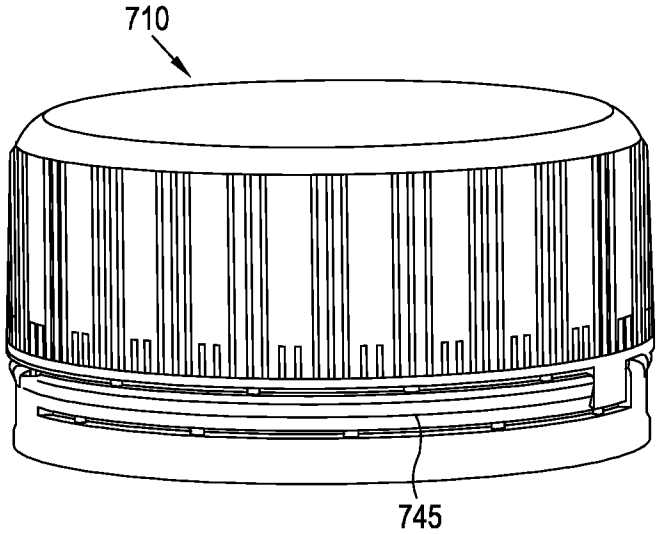
FIG. 15 is perspective view of a closure in accordance with another embodiment of the present invention.

FIG. 15 shows a one-piece closure 710 with a chicane and a moulded bridge lasso tether 745. FIG. 16 shows the closure 710 engaged on a container neck 750.

Figure 17:
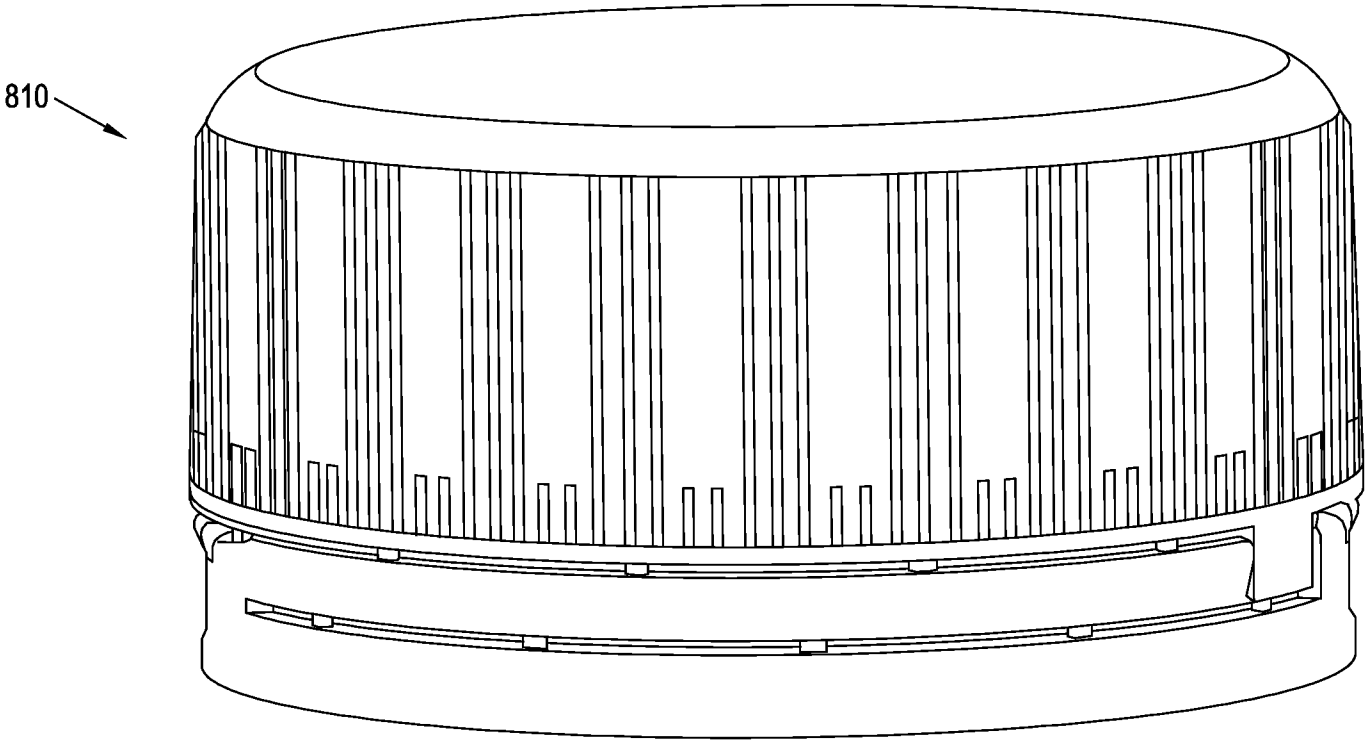
FIG. 17 is a perspective view of a closure in accordance with another embodiment of the present invention.

FIG. 17 shows a one-piece closure 810 with a chicane and a slit bridge lasso tether. The slit/bridge pattern is generally the same as for the closure 710.

Figure 18:
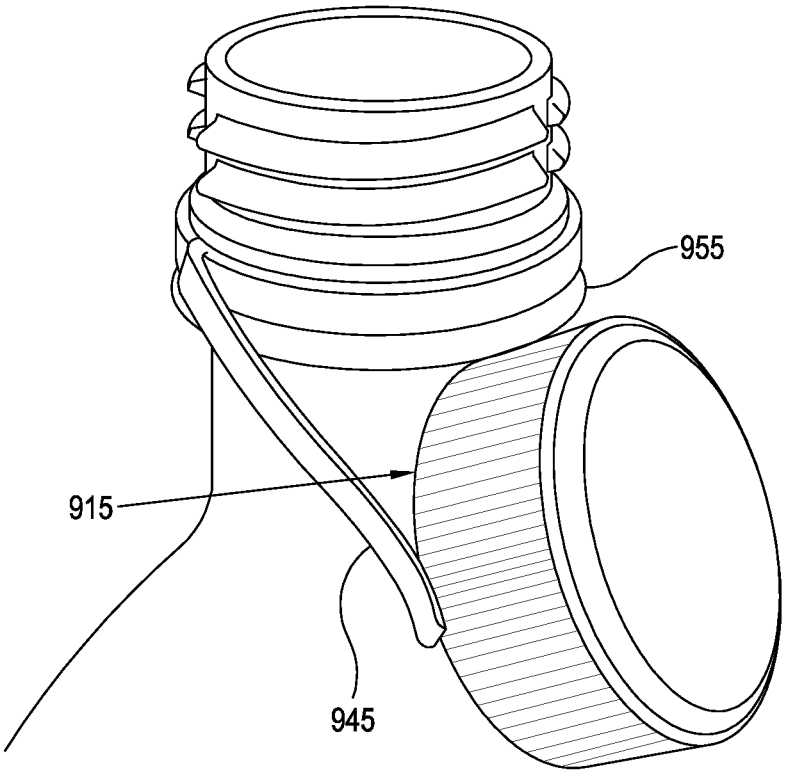
FIG. 18 is a perspective view of a closure in accordance with another embodiment of the present invention depicting a cap removed and docking under a neck transport bead.

FIG. 18 shows a closure 910 formed according to an embodiment of the present invention. The cap 915 is removed and docking under the neck transport bead 955 is enabled by the tether 945.

Figure 19:
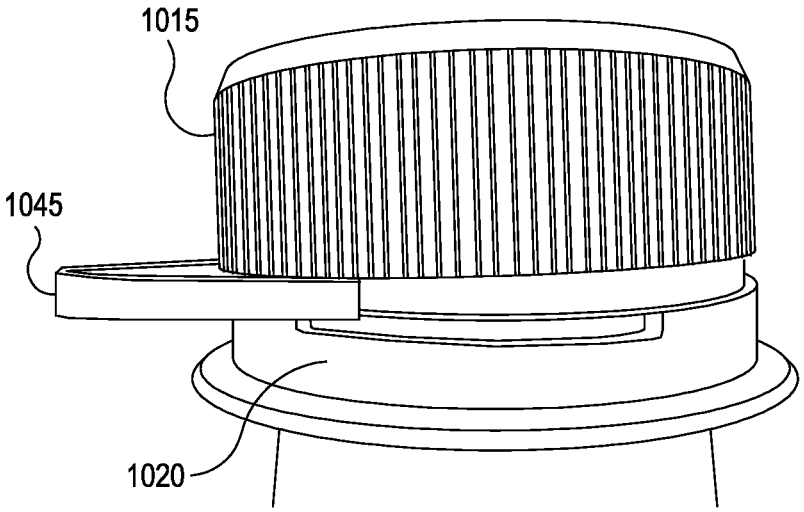
FIG. 19 is a perspective view of a closure in accordance with another embodiment of the present invention.
Figure 20:
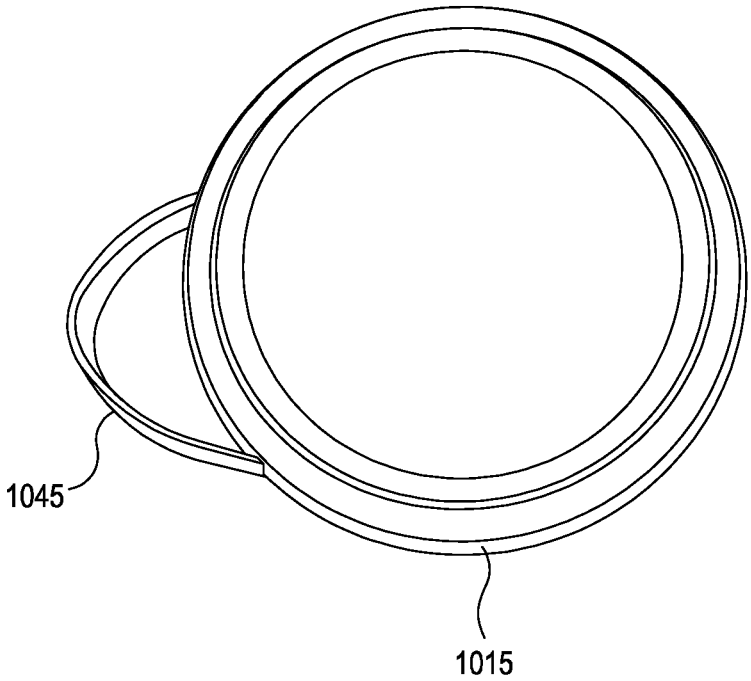
FIG. 20 is a top view of the closure of FIG. 19.

FIGS. 19 and 20 show a closure 1010 formed in accordance with an aspect of the present invention. The closure 1010 includes a clockwise extending tether of the same general type as that described above. The retaining ring 1020 fits around the container neck and exerts a certain amount of compression i.e. it is not completely freely rotatable. The cap 1015, on the other hand, is not impeded (or as impeded) in its rotation.

After the cap 1015 has been removed, when it is replaced it will be screwed onto the screw threaded neck by a clockwise rotation (i.e. in the same direction as the tether extends). The ring cannot rotate relative to the neck as fast as the cap, so the cap rotation pushes on the tamper-evident band (retaining ring) and causes the tether to bulge/buckle, as shown in FIGS. 19 and 20. This provided an additional level of tamper-evidence.

Figure 21:
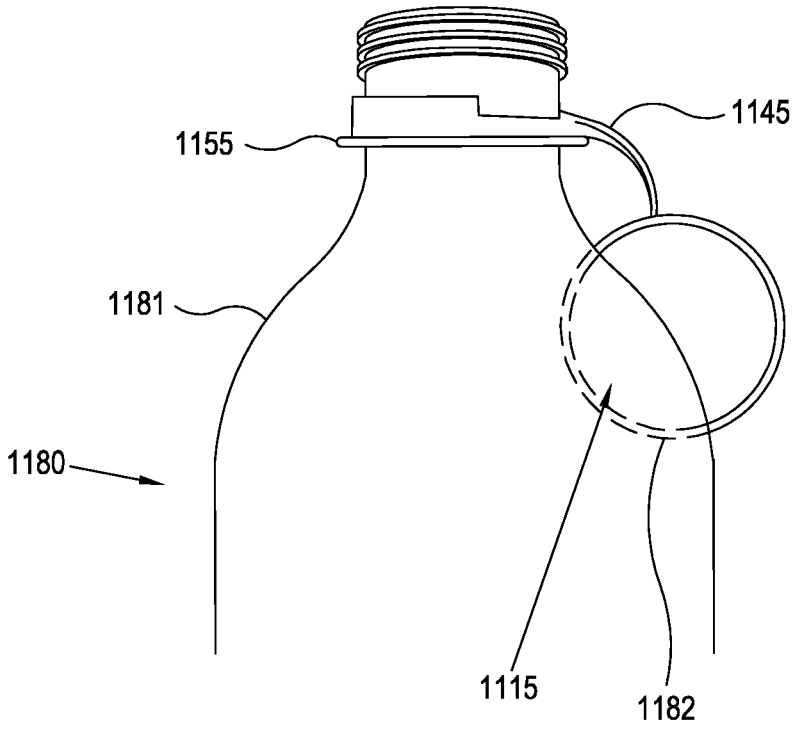
FIG. 21 is a perspective view of a bottle/cap docking system in accordance with the present invention.

FIG. 21 shows a bottle/cap docking system formed in accordance with the present invention.

The closure 1110 is a tethered closure (a clockwise or anticlockwise tether may be provided).

Beneath the neck support ring 1155 of a container 1180 a moulded recess 1182 is provided (in this embodiment in a conical part 1181 of the container and above a cylindrical part). The tether 1145 permits the cap 1115 to be twisted and pushed into the recess 1182, where it is held stably. In this embodiment, as an alternative the cap could also be docked under the transfer bead/neck support ring 1155.

Figure 22:
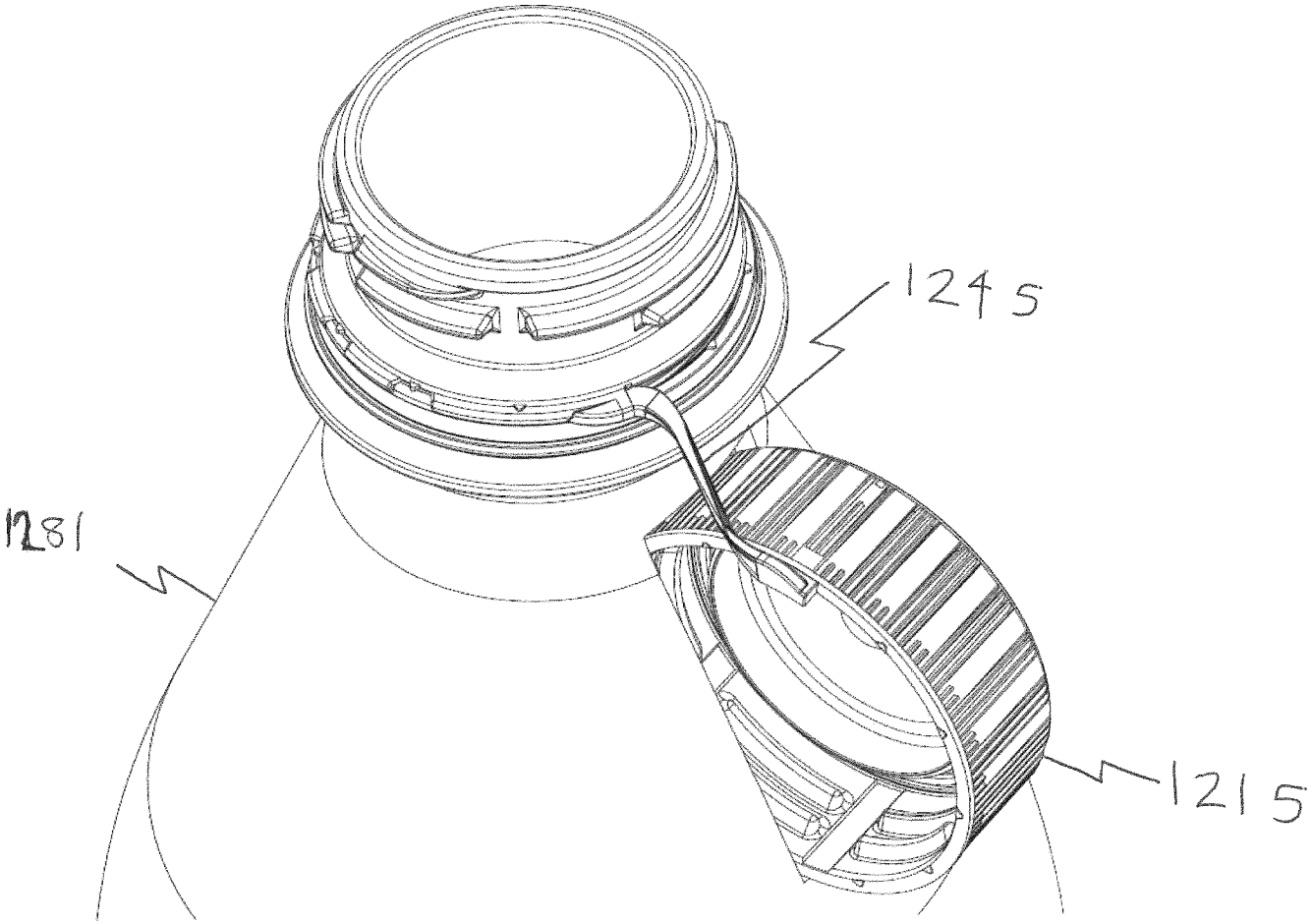
FIG. 22 is perspective view of a dockable, tethered closure in accordance with the present invention.
Figure 23:
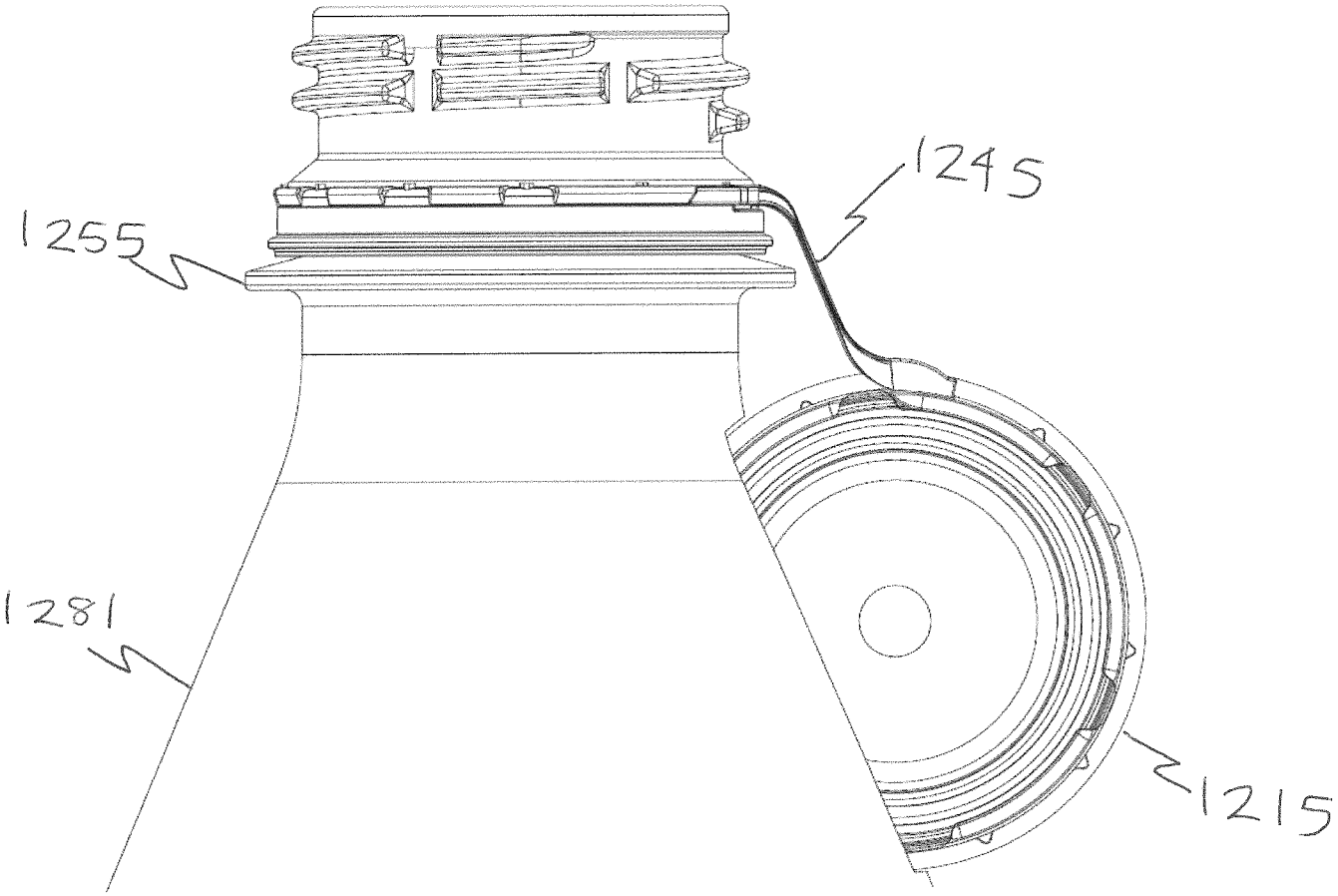
FIG. 23 is another perspective view of the closure of FIG. 23.

FIGS. 22 and 23 also show a dockable, tethered closure 1210.

Figure 24:
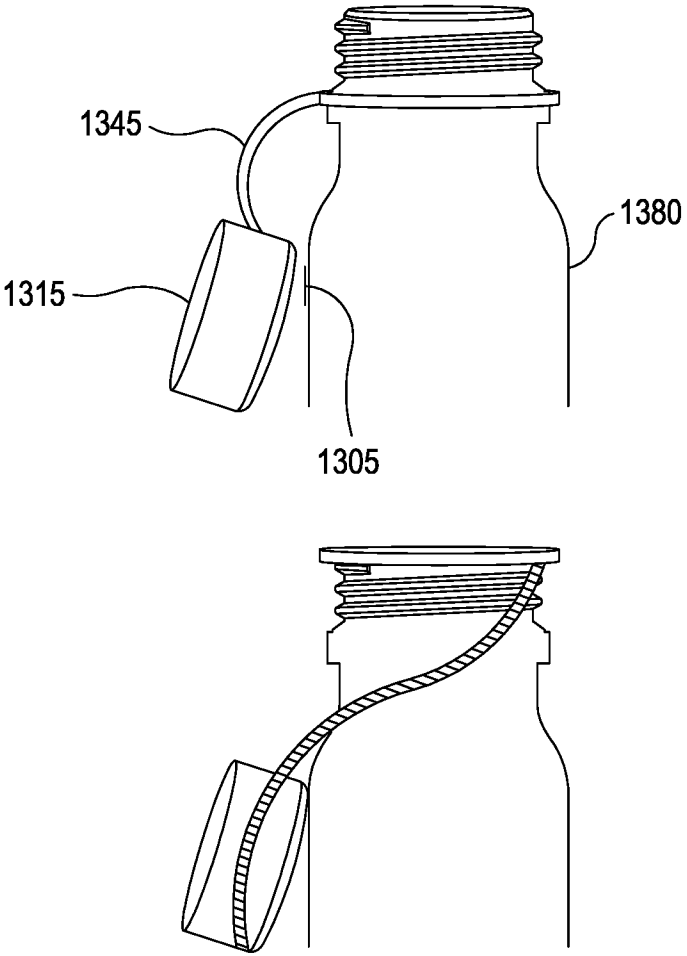
FIG. 24 is perspective view of a tethered closure in accordance with another embodiment of the present invention.

FIG. 24 shows a tethered closure 1310. In this aspect the top plate 1311 of the closure 1310 is provided with a peel-off glue sticker 1305. This means that when the cap 1315 is unscrewed it can be stuck to the side of an associated container 1380.

Figure 26:
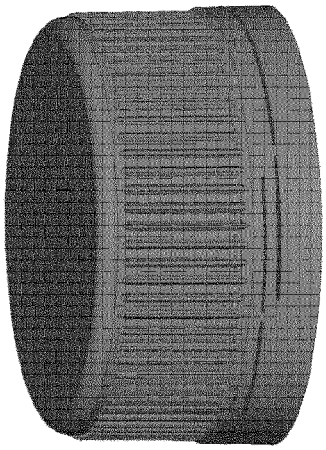
FIG. 26 is a perspective view of the closure of FIG. 25.
Figure 27:
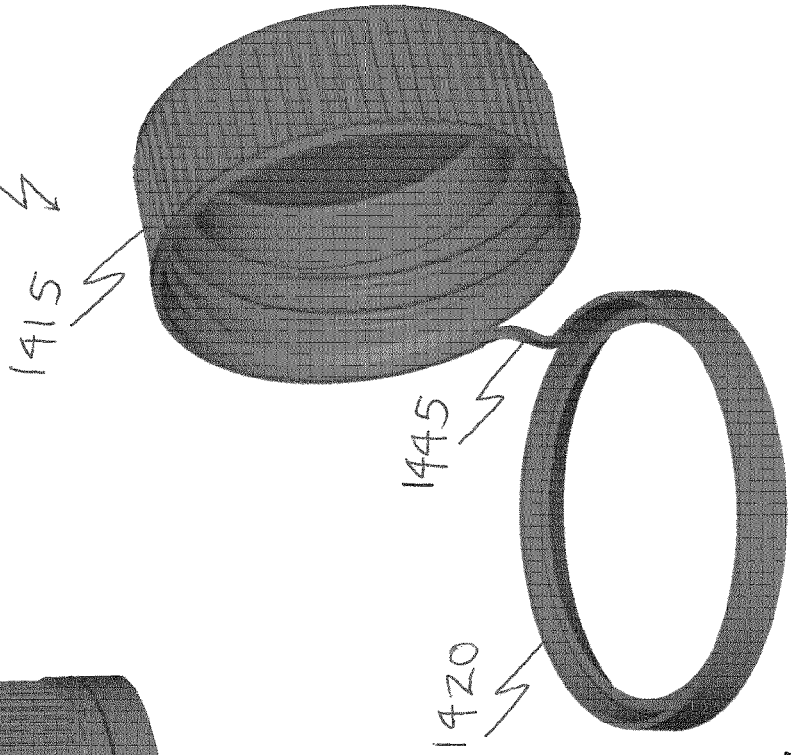
FIG. 27 is a perspective view of the closure of FIG. 25 depicting an unscrewed cap and a tether formed between the cap and a retaining band.
Figure 25:
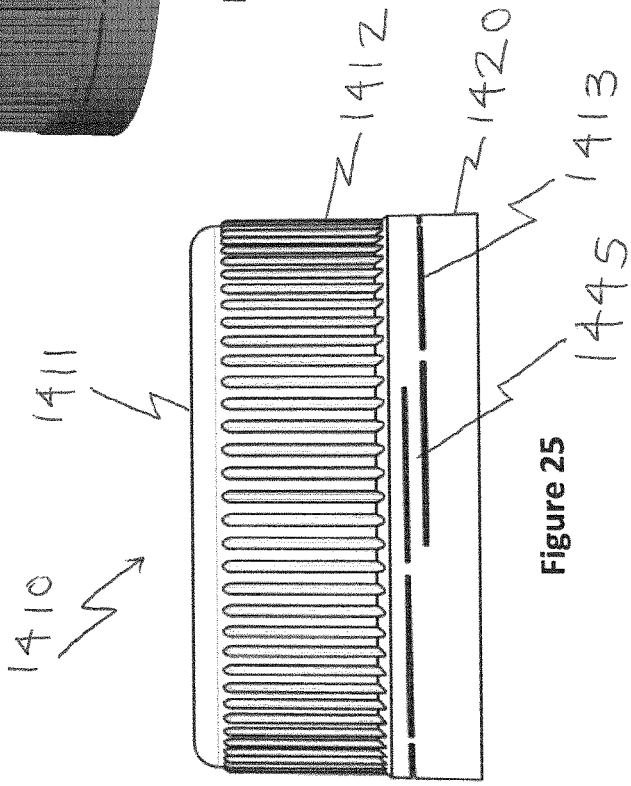
FIG. 25 is an elevational view of a closure in accordance with another embodiment of the present invention.

FIGS. 25 to 27 show a closure 1410 formed according to a further aspect.

The closure 1410 comprises a shell with a top plate 1411 and a depending side skirt 1412. Towards the free end of the skirt 1412 a helical frangible line 1413 is formed and define axially beneath it a tamper-evident retaining band 1420. In this embodiment the band 1420 (which is adapted to remain on the neck of a bottle after opening, for example using a snap bead, retention flaps or the like) is made by non-continuous cutting (slitting) of the plastics material, which leaves a plurality of breakable elements (bridges) between the band 1420 and the remaining cap 1415.

The inclination extends over 360 degrees and the remaining strap forms a lasso tether.

Deformation of the strap may provide stress whitening of the material to serve as additional tamper-evidence.

On a standard cap the cut is horizontal and 360 degrees; the unscrewing process causes complete separation of the cap and the tamper-evident band. On a standard cap, there is a cutting area, an overlap of the beginning and the end of the cut.

In this aspect due to the sloping slitting of the cap a strap is created between the lid and the tamper-evident band when slitting the sidewall. With a slitting blade longer than the perimeter of the cap, the beginning and end of the cut overlap. The slitting no longer has a cutting area, but a vertical offset sufficient to create a plastic strap connecting the cap to the band.

There are several options for achieving the vertical offset:

Option 1: with an inclination of the slitting blade;

Option 2: with an inclination of the cap when cutting;

Option 3: slitting blade with special profile, inclined or vertical offset;

Option 4: associating multiple slitting blades to create an offset.

Upon opening, the slitted bridges break and the strap 1445 is deformed to allow unscrewing and the cap stay attached to the retained band, as shown in FIG. 27.

Although illustrative embodiments of the invention have been disclosed in detail herein, with reference to the accompanying drawings, it is understood that the invention is not limited to the precise embodiments shown and that various changes and modifications can be effected therein by one skilled in the art without departing from the scope of the invention as defined by the appended claims and their equivalents.

What is claimed:

1. A closure in combination with a container having a container neck, the closure comprising a cap, and a retaining ring for retaining the closure on the container neck, a tether is provided between the cap and the retaining ring, one end of the tether is fixedly connected to the cap and the other end is fixedly connected to the retaining ring, the tether is connected to the cap by a root and extends from the root in a clockwise, cap screwing-on direction, the ring is rotatable but exerts a compression force on the container neck whereas the cap is not as impeded in its rotation on the container neck, when the cap is unscrewed and removed for the first time and then re-screwed onto the neck the ring is retarded as it rotates together with the cap and thereby rotates less than the cap causing the tether to buckle and bulge outwards along its length above the retaining ring, thereby providing evidence of tampering.

2. A combination as claimed in claim 1, in which the closure comprises a main frangible line formed between the cap and the ring.

3. A combination as claimed in claim 2, in which a tether-forming frangible line is formed axially beneath the main frangible line.

4. A combination as claimed in claim 3, in which the interface between the main frangible line and the tether-forming frangible line is chicane-like.

5. A combination as claimed in claim 1, in which a circumferential extent of the tether-forming frangible line is: in the range 10 degrees to 40 degrees; in the range 40 degrees to 70 degrees; approximately 55 degrees; in the range 70 degrees to 120 degrees; or approximately 90 degrees.

6. A combination as claimed in claim 1, in which the retaining ring includes a bead for retaining the ring on a container mouth.

7. A combination as claimed in claim 1, in which the retaining ring comprises one or more retaining flaps for retaining the ring on a container mouth.

8. A combination as claimed in claim 1, in which a cross section of the tether is in the range 0.5 $mm^2$ to 3 $mm^2$.

9. A combination as claimed in claim 1, comprising one or more frangible lines, in which the frangible line/s are formed by moulded bridges.

10. A combination as claimed in claim 9, comprising one or more frangible lines, in which the frangible lines are slit.

11. A combination as claimed in claim 1, in which the tether is formed in the ring.

12. A combination as claimed in claim 1, in which the cap is able to be in a docked position on a container mouth.

13. A combination as claimed in claim 1, in which the retaining ring is retarded as it rotates together with the cap, the difference in rotation causing the cap to overtake the ring and causing deformation of the tether, the deformation providing an additional visual form of tamper evidence.

14. A combination as claimed in claim 1, in which the cap comprises a top plate and a side wall depending from the periphery thereof, the retaining ring being arranged axially beneath the side wall.

15. A combination as claimed in claim 1, in which the cap comprises a base and a lid hingedly connected together and a dispensing member, the retaining ring is formed on the base.

16. A combination as claimed in claim 1, in which the container has a neck transport bead and in which the tether enables the cap to be able to assume a docked position under the neck transport bead.

17. A combination as claimed in claim 1, in which the container includes a molded recess and the cap is able to assume a docked position in the recess.

* * * * *